US010034561B2

(12) United States Patent
Horton

(10) Patent No.: US 10,034,561 B2
(45) Date of Patent: Jul. 31, 2018

(54) ORDER RACK OR ORDER REEL

(71) Applicant: XLR Rail Ticket Systems Pty Ltd, Victoria (AU)

(72) Inventor: Scott Horton, Victoria (AU)

(73) Assignee: XLR RAIL TICKET SYSTEMS PTY LTD, Victoria (AU)

( * ) Notice: Subject to any disclaimer, the term of this patent is extended or adjusted under 35 U.S.C. 154(b) by 63 days.

(21) Appl. No.: 15/118,289

(22) PCT Filed: Feb. 12, 2015

(86) PCT No.: PCT/AU2015/050050
§ 371 (c)(1),
(2) Date: Aug. 11, 2016

(87) PCT Pub. No.: WO2015/120517
PCT Pub. Date: Aug. 20, 2015

(65) Prior Publication Data

US 2016/0360902 A1 Dec. 15, 2016

(30) Foreign Application Priority Data

Feb. 12, 2014 (AU) ..... 2014900412
Sep. 11, 2014 (NZ) ..... 631354

(51) Int. Cl.

| | |
|---|---|
| ***A47F 7/16*** | (2006.01) |
| ***A47F 10/06*** | (2006.01) |
| ***B42F 9/00*** | (2006.01) |
| ***G09F 11/23*** | (2006.01) |

(Continued)

(52) U.S. Cl.
CPC ..... *A47F 10/06* (2013.01); *B42F 9/002* (2013.01); *G09F 1/103* (2013.01); *G09F 11/23* (2013.01); *G09F 23/06* (2013.01)

(58) Field of Classification Search
CPC .. A47F 10/06; A47F 5/08; A47F 7/163; A47F 7/143; A47F 3/08; A47F 7/166; B42F 9/002; B42F 15/06; B42F 15/066; B42F 9/00; G09F 1/103; G09F 11/23;
(Continued)

(56) References Cited

U.S. PATENT DOCUMENTS 2,526,536 A * 10/1950 Bryan ..... A47F 10/06 198/803.7
2,582,178 A * 1/1952 Thompson ..... A41H 42/00 198/346

(Continued)

OTHER PUBLICATIONS

"Metal Snap on Promotional Price Card Holder for Clothes Rails", Trader Supplies Co. UK. (http://www.tradersupplies.co.uk/catalogsearch/result/?q=GR-PCH-SNPO).

*Primary Examiner* — Jennifer E. Novosad
(74) *Attorney, Agent, or Firm* — Hoffmann and Baron, LLP

(57) ABSTRACT

An apparatus for the display of orders, especially suited for use in restaurants, commercial kitchens and the like, includes a holder element for receiving and releasably retaining an order, and an element upon which a plurality of said holder element can be releasably mounted for display, as well as for display, as well as for selective and controlled movement therealong. The holder mounting element may be in the form of either an elongate member or rail or a continuous loop.

33 Claims, 13 Drawing Sheets

(51) Int. Cl.
*G09F 23/06* (2006.01)
*G09F 1/10* (2006.01)

(58) Field of Classification Search
CPC ... G09F 23/06; G09F 3/16; G09F 3/20; G09F 11/12; G09F 11/18; B65G 1/12; B65G 17/32
USPC ..... 211/45, 122, 1.52, 1.53, 70.6, 124; 206/481, 482, 477; 248/309.1; 198/678.1, 681, 685, 465.2; D6/322; 40/500, 506, 504, 658, 666
See application file for complete search history.

(56) References Cited

U.S. PATENT DOCUMENTS 2,595,837 A * 5/1952 Freeman ..... D06F 93/00 188/83
2,778,504 A * 1/1957 Byrne ..... A47F 3/08 186/35
3,314,177 A * 4/1967 Mies, Jr. et al. ..... B42F 17/08 211/115
3,655,030 A * 4/1972 Hardwig ..... B65G 47/48 104/172.3
3,891,061 A * 6/1975 Grogan ..... B65G 17/20 186/14
3,953,065 A * 4/1976 Shannon, Jr. ..... A47F 5/0006 211/113
4,743,050 A * 5/1988 Small ..... B62B 3/1428 281/45
4,899,974 A * 2/1990 Wear ..... A47G 1/21 211/45
5,533,632 A * 7/1996 Patterson ..... A47F 5/025 198/678.1
5,711,431 A * 1/1998 Reichert ..... A47F 5/0884 211/122
8,234,806 B1 * 8/2012 Raheb ..... F24C 15/00 248/280.11
8,596,473 B2 * 12/2013 Newbould ..... A47B 96/067 211/88.01
2002/0139025 A1 * 10/2002 Pitcher ..... G09F 15/0018 40/611.12
2016/0360902 A1 * 12/2016 Horton ..... A47F 10/06

* cited by examiner

ORDER RACK OR ORDER REEL

This application is a U.S. National Phase Application of, and Applicant claims priority from, International Application No. PCT/AU2015/050050, filed on Feb. 12, 2015, which claims priority from Australian Application No. 2014900412, filed on Feb. 12, 2014, and New Zealand Patent No. 631354, filed on Sep. 11, 2014, which are all incorporated in their entirety herein by reference.

FIELD OF THE INVENTION

The present invention, in general terms, relates to improvements in what are hereinafter to be referred to as order display systems, and order racks or wheels to be associated therewith, and also to improvements in parts of and accessories therefor. More particularly, but not exclusively, the invention relates firstly to an improved order rack or wheel, and secondly to an improved ticket or order holder to be used in conjunction therewith.

BACKGROUND OF THE INVENTION

What shall hereinafter be referred to as order display apparatus, including order racks or order wheels, enjoy usage in a variety of different contexts in the hospitality industry nowadays, as for example in restaurants and in commercial kitchens, wherein information is to be displayed, temporarily, for purposes of use as by actioning in a predetermined or variable order of priority.

Throughout the ensuing specification the expression "order" is intended to refer to, in particular, a listing of food requested by a customer, or one or more customers, in a restaurant, café, bistro, or the like establishment. Such listing, selected from the different items set out on a menu, a notice board etc., will be taken from the customer (or customers) by a waiter/waitress, for example, to be delivered to the cooking/catering area to be filled.

In any restaurant or commercial kitchen, regardless of size or output, it is an established practice for meal orders to be taken from customers, as by waiters and/or waitresses, and then forwarded to the kitchen or cooking area for filling. Whether a meal order is in the form of a hand-written sheet, card or the like, or in electronic form, the aim of the exercise, so as to "keep the customer satisfied", is to have such orders filled in a timely manner, for delivery to the customer, whether that customer be intending to consume the meal in the restaurant or take it away. Furthermore, in any restaurant, cafeteria or the like the aim should almost invariably be to have orders filled on a "first in, then first out" basis. This means that orders need to be arranged/displayed and viewable by the cook/chef/kitchen staff to ensure proper management and expeditious completion of any and all orders.

Once the order(s) is(are) delivered to the kitchen, whether physically or electronically, it(they) need to be displayed so as to allow the kitchen staff/chefs/cooks to fill them, more preferably in the order received chronologically or in some other preferred order. It has been an established practice in restaurants and the like establishments to have, within the kitchen area, means for displaying the orders so as to allow them to be actioned or filled as appropriate.

Order display apparatus of this general type can take the form of either an elongate rack, to which orders can be removably attached, being added at one end and removed at the other, and progressively moved from one end to the other as they are actioned. With a display apparatus of the elongate rack type, movement of orders is conventionally achieved by first actually physically or manually removed from the rack and repositioning thereon. Orders are permanently removed when filled. In the alternative, all order display apparatus can take the form of a wheel or loop structure adapted to receive orders, that wheel being rotatable to allow for adding of new orders or removal of filled orders.

In a restaurant or commercial kitchen, an order rack or order wheel may preferably located so as to be readily accessible to both waiters and waitresses—who are responsible for taking/accepting meal orders from customers/diners—and the kitchen staff/chefs—who are responsible for filling such orders by cooking the relevant meals/food. Alternatively, the order rack or wheel will be located in the kitchen area, for access by the cooking staff. One current practice is that, after an order or orders is or taken and written or in some other way noted, or in an alternative entered an order or orders in a computerised point-of-sale system such order or orders will be attached to, the order rack or wheel. The kitchen staff can then, at their leisure, access the orders either manually or after printing out a copy of an electronic order, and prepare the meals in accord therewith which, when ready, are collected by the waiters and waitresses for delivery/serving to the diner(s).

With either arrangement, once an order is being prepared the cook/kitchen staff will either move filled orders laterally of the rack or rotate the wheel, whereby to allow access to/viewing of subsequent and as not yet filled orders.

The wheel generally keeps the orders in chronological order of time taken, so that the first order placed on the wheel is the first order started to be prepared by the chef/cool/kitchen staff. When an order is completed, the check for such order is removed from the wheel and placed with the plate or plates of food ordered on a counter for the waiter/waitress to pick up and deliver to the diner. When a check is removed from the wheel, the wheel is advanced by the chef/cook/kitchen staff to get to the next order check. While an order wheel is effective for moving order checks from the waiter/waitress to the chef/cook, particularly where the chef/cook works on only one or two meals at a time, where several meals are being worked on at the same time the chef/cook has to continually turn the wheel back and forth to find the particular order being worked on and to keep the orders in time order on the wheel.

PRIOR ART

It is a common practice in restaurants/commercial kitchens to use order racks/order wheels of this general type. Typically, an order rack or wheel may be located between an area where customers/guests are served and the kitchen area where meals are cooked/prepared. A waiter or waitress, will take an order or orders from a customer or customers and will write such order on a piece of paper or other material ticket, and the order or orders then located on a rack or wheel and places that ticket thereon, on one or more what shall be referred to as clips or ticket holders which are appropriately disposed on the rack/wheel itself. The cook/kitchen staff can then view the ticket or order and prepare the meal/order in accord therewith. In arrangements currently in vogue the cook/kitchen staff will rotate the order rack or wheel in such a way that orders clipped or held thereon are rotated to a position which allows for reading thereof, in turn to allow for preparation of the food ordered. This procedure of rotation of clips or ticket holders housed on the rack or wheel will be pursued continuously, with orders then to be prepared in turn, this to ensure timely preparation of food and delivery thereof to the relevant guests/customers/diners.

When an order is filled, the cook or kitchen staff will move to remove the relevant ticket from the order rack or wheel. When such a ticket is removed, then the rack or wheel will be advanced to allow for preparation/settling of the next order, as appearing on the next ticket in chronological order (order of placement).

In the past there have been a number of methods and means employed in such a context, one being in the form of an elongate rack, and another being in the form of an order wheel which is rotated as new orders are placed thereon.

There have been found, through experience, to be a number of problems associated with the prior art order racks and order wheels, whether of the fixed (stationary) type or of the rotating type.

One of these problems is the need for excessive handling and repositioning of tickets or dockets on the rack or wheel itself, due to the need for constantly making room on the rack or wheel to allow for the location of new orders thereon.

Another problem is associated with the need to manually move each ticket or holder by pulling out one at a time and manually repositioning such. The need therefor can be a source of constant frustration and wastage of time. By way of example only, if there exist on a given rack or wheel a number of tickets in line in what is referred to as a "first-in, first-out" order, then when a ticket is completed and removed a gap is created, which needs to be filled. In such a situation all the other tickets need to be individually moved to ensure that such a gap is filled.

It has been found that fixed stationary racks or rails and rotating systems do not allow for easy insertion of new orders between existing orders already in line. This means that all other orders need to be moved to make space for a fresh order or ticket holder. The reverse applies in the situation, for example, where a ticket or holder is removed from the rack or wheel prior to reaching the front of the priority line.

Existing rotating systems allow another user or member of the kitchen staff to in effect interrupt the system by moving tickets/holders to suit their purposes, as for example to make viewing thereof easier, which causes disruption to other users. It should furthermore be understood that two-sided systems of the type currently in use limit user mounting options.

Existing clips or means for affixing tickets or orders in place relative to a rack (whether fixed or rotating) generally require two-handed operation, with one hand then needed to open the clip and the other to insert the ticket. This gives rise to wastage of time and effort.

The present invention seeks to overcome the problems and disadvantages associated with the prior art by providing an improved docketing system or order rack.

The invention also seeks to provide an improved ticket or order holder for use with such a docketing system.

In accordance with one aspect of the present invention, therefore, there is provided a holder for releasably receiving and retaining thereon an order (as hereinafter defined) or the like material, said holder including: a main body member having opposed respective front and rear surfaces, the front surface having means associated therewith for receiving and releasably retaining said order relative thereto, said front surface having associated therewith attachment means which allows said holder to be releasably attachable to a mounting means, which is releasably attachable to a surface, preferably a wall, to allow for selective and controlled sliding and/or rolling movement therealong and/or ready removal from and replacement on said mounting means at any selected location along the length dimension thereof.

In accordance with another aspect of the present invention there is provided an apparatus for the temporary display thereon of a plurality of orders (as hereinbefore defined), said apparatus including: a plurality of holders, each including means for receiving, and releasably retaining an individual order thereon; and a mounting means which is releasably attachable to a surface, said mounting means receiving and releasably retaining said holders, with and/or without an order associated therewith, the arrangement being such as to allow for location on, removal from and/or selective movement of one or more of said holders relative to said mounting means, wherein the or each said holder includes a main body and means for receiving and releasably, retaining relative to said main body, an individual order.

DESCRIPTION OF THE DRAWINGS

In order that the invention may be more clearly understood and put into practical effect reference will now be made to preferred embodiments of an order rack or wheel, and components thereof, in accordance with the present invention. The ensuing description is given by way of non-limitative example only and is with reference to the accompanying drawings, wherein.

DESCRIPTION OF PREFERRED EMBODIMENTS

Figure 2:
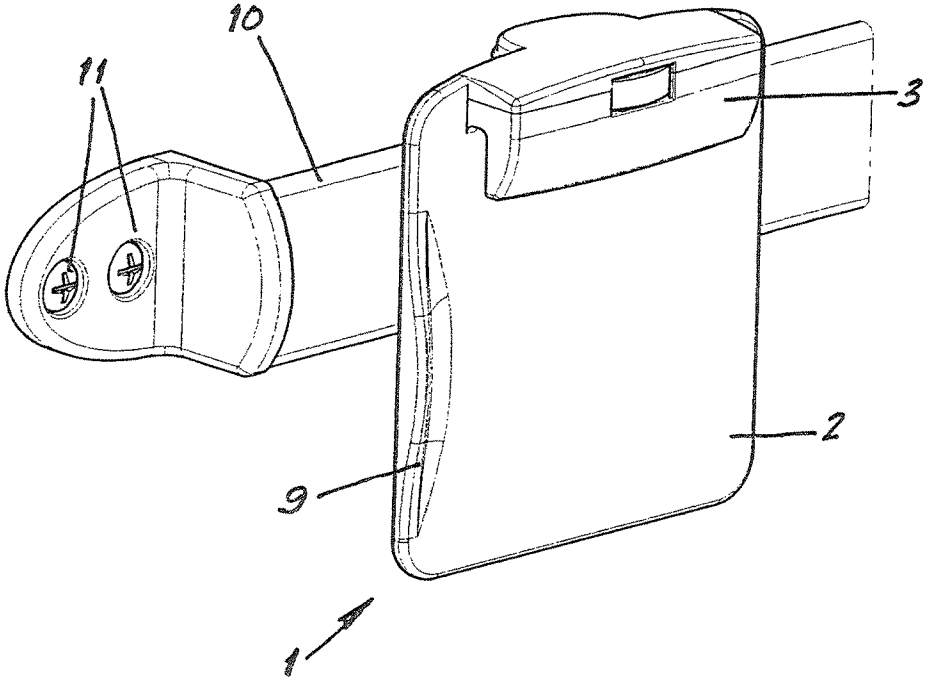
FIG. 2 is a perspective view of the preferred embodiment of ticket or docket holder of FIG. 1, as located relative to a fixed rail.
Figure 1:
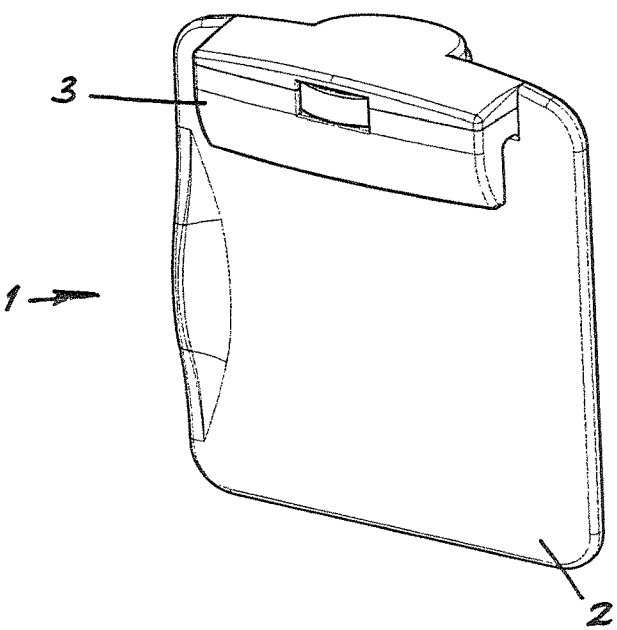
FIG. 1 is a top perspective view of a preferred embodiment of a ticket holder or docket holder in accordance with the present invention.

The drawings show various views of an improved ticket or order holder, generally designated 1, in accordance with the present invention. That order holder 1 includes, as a principal component, a main body 2 having a fixing means or holder 3 disposed at or in the vicinity of the uppermost end or edge of that main body 2. The main body 2 and fixing means or holder 3 preferably are formed as an integral unit and may be constructed of any suitable material, be that metal, plastics or otherwise. The material of construction and mode or method of production do not constitute part of the invention. The fixing means or holder 3, in the preferred embodiment shown, is in the form of a shaped hook-like protrusion which depends downwardly from the uppermost end or edge of the overall holder 1, leaving a gap 4 between the surface of the main body 1 and the fixing means or holder 3. As shown for example in FIG. 6 the fixing means or holder 3 is hollow and is adapted, in use, to have disposed therein an elongate member or rod 5 which functions to secure a ticket or order in place relative to the main body 1, via friction and/or gravity. In alternative arrangements, also shown in FIG. 6, instead of a solid rod 5 an array or row of ball bearings 5*a*, or even a hollow tube 5*b*, may be used. The order holder 1 is so shaped as to allow for ready and removable attachment to a rail or the like 10 as shown, for example, in FIG. 2. The rail 10 can be of any suitable length, to suit the requirements of the kitchen. That rail or the like 10 may be able to be releasably affixed to a surface by any suitable means, as for example screws 11 (see FIG. 2), with the interposition of a bracket or any other suitable and known means.

Figure 4:
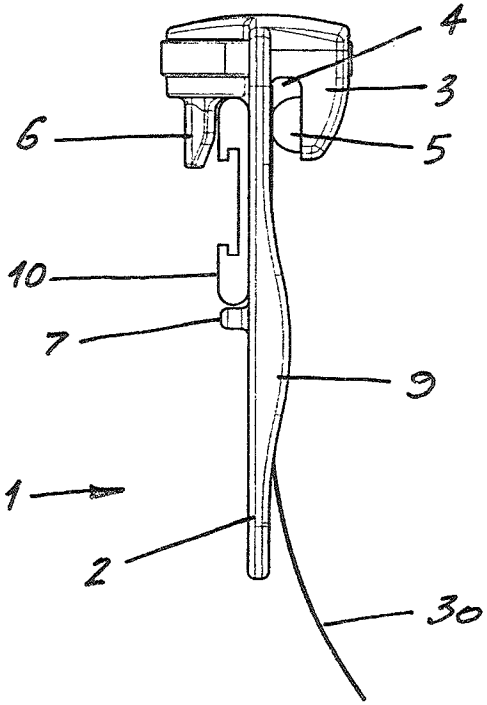
FIG. 4 is a side view of the ticket or docket holder and associated ticket or docket shown in FIG. 3.
Figure 3:
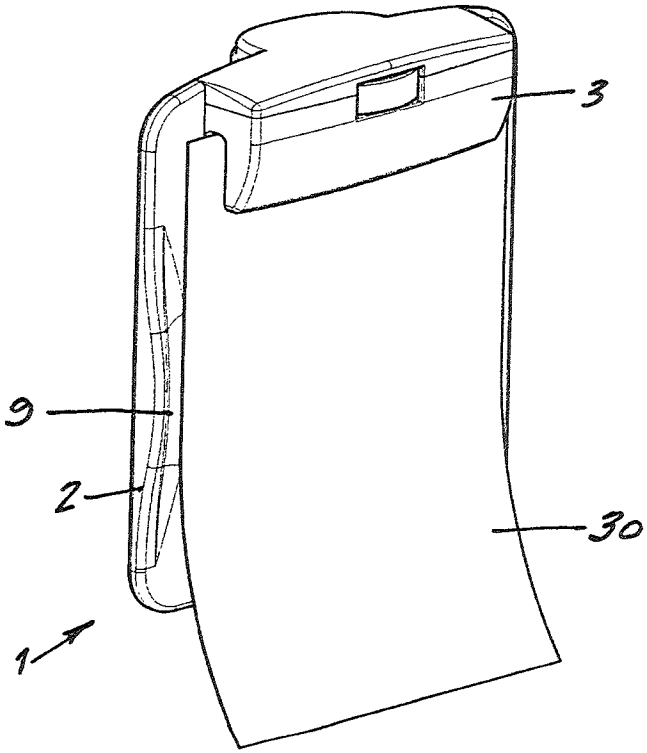
FIG. 3 is a perspective view of the preferred embodiment of the ticket or docket holder shown in FIG. 1, having a ticket or docket associated therewith.

To that end, and as shown for example in FIG. 4 on the reverse side of the holder 3 there is provided, at or in the vicinity of the uppermost edge thereof, a further hook-like or hook-shaped protrusion 6 and, spaced downwardly therefrom, at least one projection 7. As shown in FIG. 4 the projection 7 acts as a seating for the lower end of the rail 10, with the upper end of that same rail 10 being disposed under/within the hook-shaped protrusion 6, as to allow the order holder 1 to be held or clipped in place relative to the rail 10 as shown.

Figure 5:
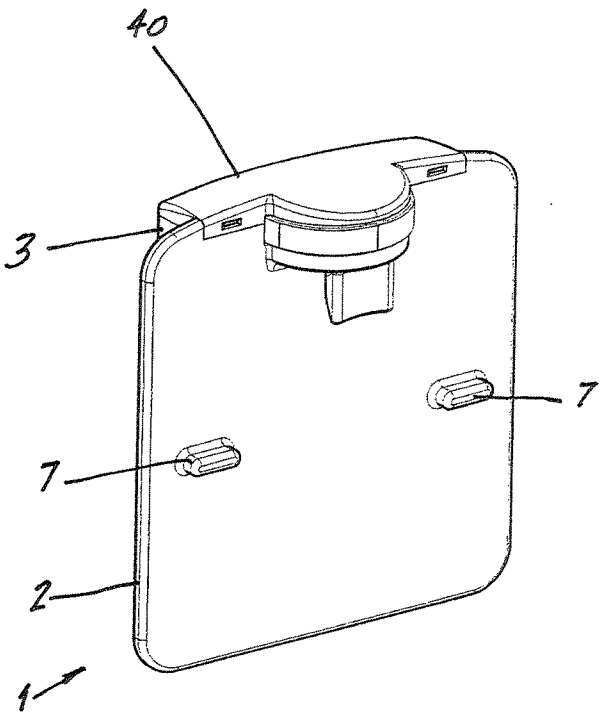
FIG. 5 is a top perspective view, from the rear, of the preferred embodiment of the ticket or docket holder shown in FIG. 1.

As shown in FIG. 5, for example, the main body 1 includes, extending from the rear surface thereof, at least one, and preferably two, protrusions 7 which function to prevent the ticket holder 1 from being inadvertently dislodged from the rail 10, or from swinging relative to that rail 10, when pushed or moved therealong.

Figure 6:
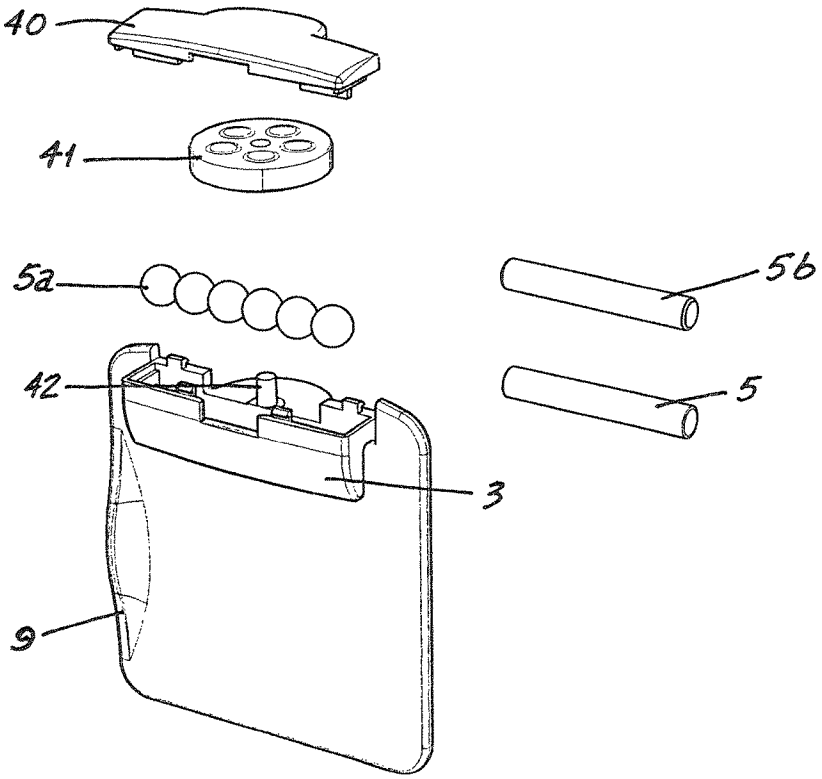
FIG. 6 is an exploded view, from the front, of the preferred embodiment of ticket or docket holder shown in FIG. 5.

As shown in FIG. 6 on the front surface of the main body 1 and preferably at or in the vicinity of one side thereof, namely the left-hand side (but alternatively on the right-hand side), there may be formed a ramp 9. The function of this ramp 9 is to prevent an order or ticket from being creased (which could affect legibility of information appearing thereon) when adjacent holders 1 are pushed against one another or come into contact with one another. Creasing can give rise to difficulty in reading the relevant order, with obvious consequences.

In one embodiment an order rack can take the form of an elongate member or rail 10, of any given length, to which a plurality of holders 1 may be releasably attached, and adapted to be movable therealong from one end to the other, with new orders preferably being attached at one end and filled or completed orders removed at the other end. Such a rack or rail 10 can be fixed in place relative to any given surface, using any known means.

In the alternative embodiments shown in FIGS. 11 to 23, for example, the rack of FIGS. 1 to 10 may be replaced by a rail 20 in the form of a closed loop, of any given circumference dependent on the size of the restaurant, number or orders likely to be taken and needed to be filled in any given timeframe, etc.

Figure 11:
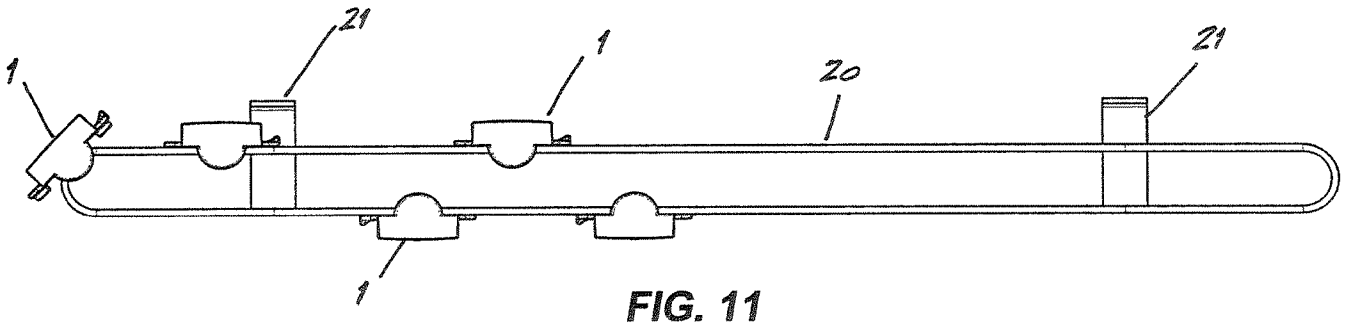
FIG. 11 is a top view of a preferred embodiment of an improved order wheel in accordance with the present invention, having disposed/located thereon a plurality of ticket or docket holders of the type as shown in FIG. 1.
Figure 12:
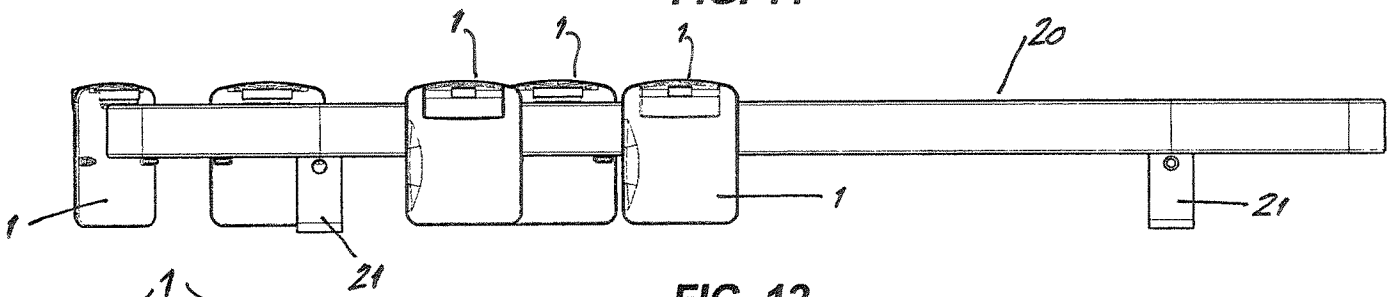
FIG. 12 is a side elevational view of the order wheel of FIG. 11.
Figure 13:
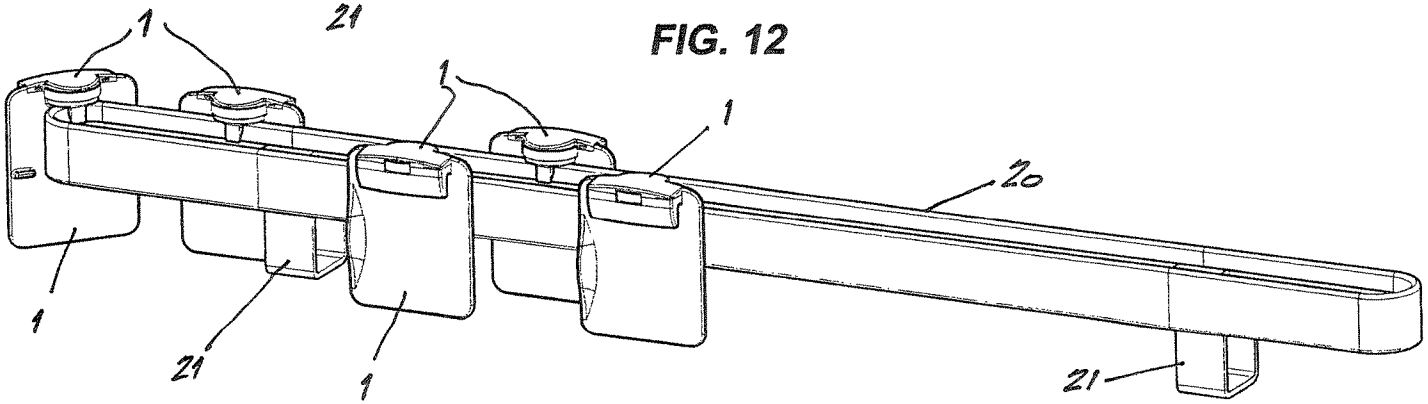
FIG. 13 is a top perspective view of the order wheel of FIGS. 11 and 12.

FIGS. 11 to 13 show a preferred embodiment of an order wheel in accordance with the present invention. As shown the wheel is made up of a rail 20 which, when viewed in top plan, will be in the form of a closed loop of any desired shape and, in the preferred embodiment is, of a substantially elliptical shape. That rail 20 may be affixed, releasably or permanently, to any given surface in any known manner and using any known means, as for example a plurality of spaced-apart shaped brackets 21 and associated fixing means (nuts and bolts, screws, rivets or the like).

The rail 20, of any length as required by the user, has associated therewith, and selectively and progressively movable therealong, a plurality of ticket holders or order holders 1, each adapted to have a ticket or order releasably associated therewith. Preferably new orders are located on the wheel for viewing by chefs/kitchen staff. As shown, holders 1 with orders thereon are moved progressively in a clockwise (or alternatively anticlockwise) manner around the loop formed by the rail 20. Once an order is filled, the relevant ticket or order can be removed from the relevant holder 1 and that holder 1 then moved from the rear to the front of the wheel, to allow for re-use.

Figure 14:
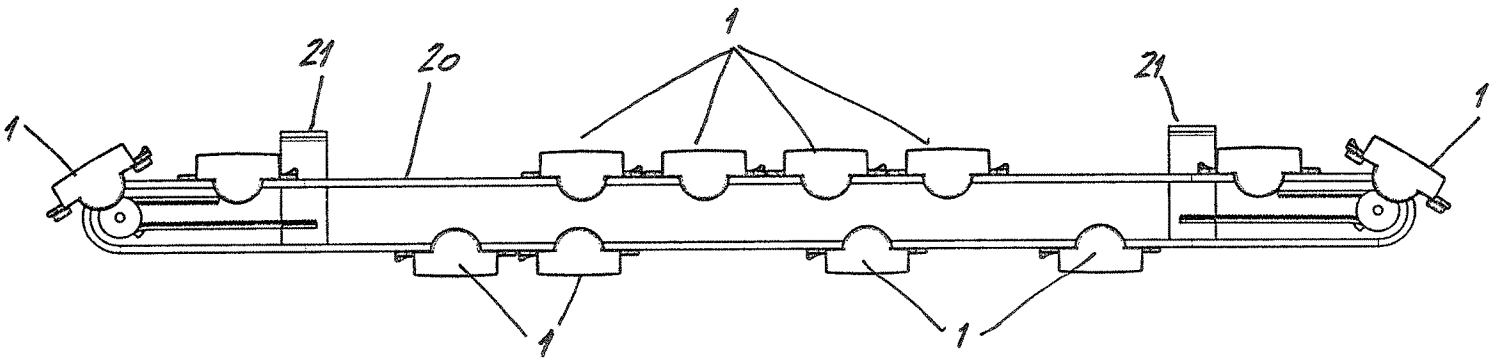
FIG. 14 is a view, similar to FIG. 11, but of an alternative embodiment of an order wheel in accordance with the present invention.
Figure 15:
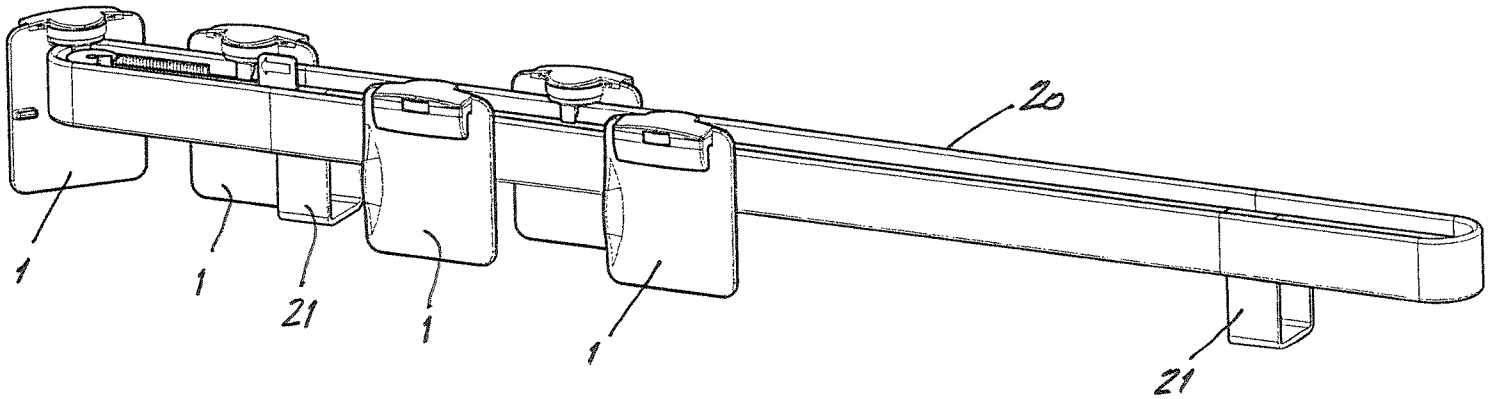
FIG. 15 is a top perspective view of the embodiment of an order wheel as shown in FIG. 14.

FIGS. 14 and 15 are further views of another preferred embodiment of an order wheel in accordance with the present invention showing a plurality of holders 1, without orders, associated therewith. At the left-hand end of the rail 20 there is shown a 1 holder which is actually traversing a corner or end of the rail 20 and an empty holder 1 is also shown (having had its completed order removed therefrom) traversing the other end or corner at the right-hand side.

Returning to FIGS. 5 and 6 there is provided, at or in the vicinity of the uppermost edge or end of the ticket holder 1, a cover 40 of a complementary shape to the fixing means or holder 3, such to be releasably affixed to the ticket holder 1 with the interposition of a rotatable member or wheel 41 disposed rotatably on a pivot axis 42. The rotatable member or wheel 41 may be divided, circumferentially, into a plurality of discrete segments or sections, which may be used to represent priority of the relevant order. For example the sections or segments can each display a different colour, indicating a pre-determined order of priority of service. In an alternative embodiment a simple numbering or alphabetical sequence can be disposed thereon.

There is shown in FIG. 14 an order wheel in accordance with the present invention which involves a rail 20 in the form of a continuous loop, affixed to an appropriate surface in any known way and using any known means, with that rail 20 having a plurality of clip members or order holders 1 removably affixed thereto and selectively and controllably movable therealong. With such an arrangement there can be problems associated with a clip member or order holder 1 negotiating the curved end sections of the overall wheel or rail 20. In that regard reference is made to, for example, FIGS. 11 and 12 whereon two clip members or order holders 1 are shown travelling around the respective ends of the wheel. In accordance with the present invention a number of means or mechanisms have been developed to facilitate cornering of the clip members or ticket holders 1, these to be explained in more detail hereinafter.

With the embodiment of FIGS. 14 and 15, a rail may be affixed to or supported on a preferably vertical surface, but in an alternative embodiment a substantially horizontal surface, in any known way, as for example by means of a plurality of brackets 21. At each end of the loop which makes up the order wheel there is provided a mechanism, as shown in exploded view in FIG. 16, which includes as its principal components a cam member 102, a spring means 103 and an actuator 104. The arrangement is such that a ticket holder 1 when moved physically, as for example by hand, to the vicinity of the end of the loop serves to rotate the cam member 102 which, in turn, drags the ticket holder 1 from the front to the rear of the rail 20. Whilst, in the embodiment shown, movement of the ticket holder(s) 1 is by hand, in an alternative embodiment (not shown) a motor or the like may be included to drive the cam member 102.

Figure 16:
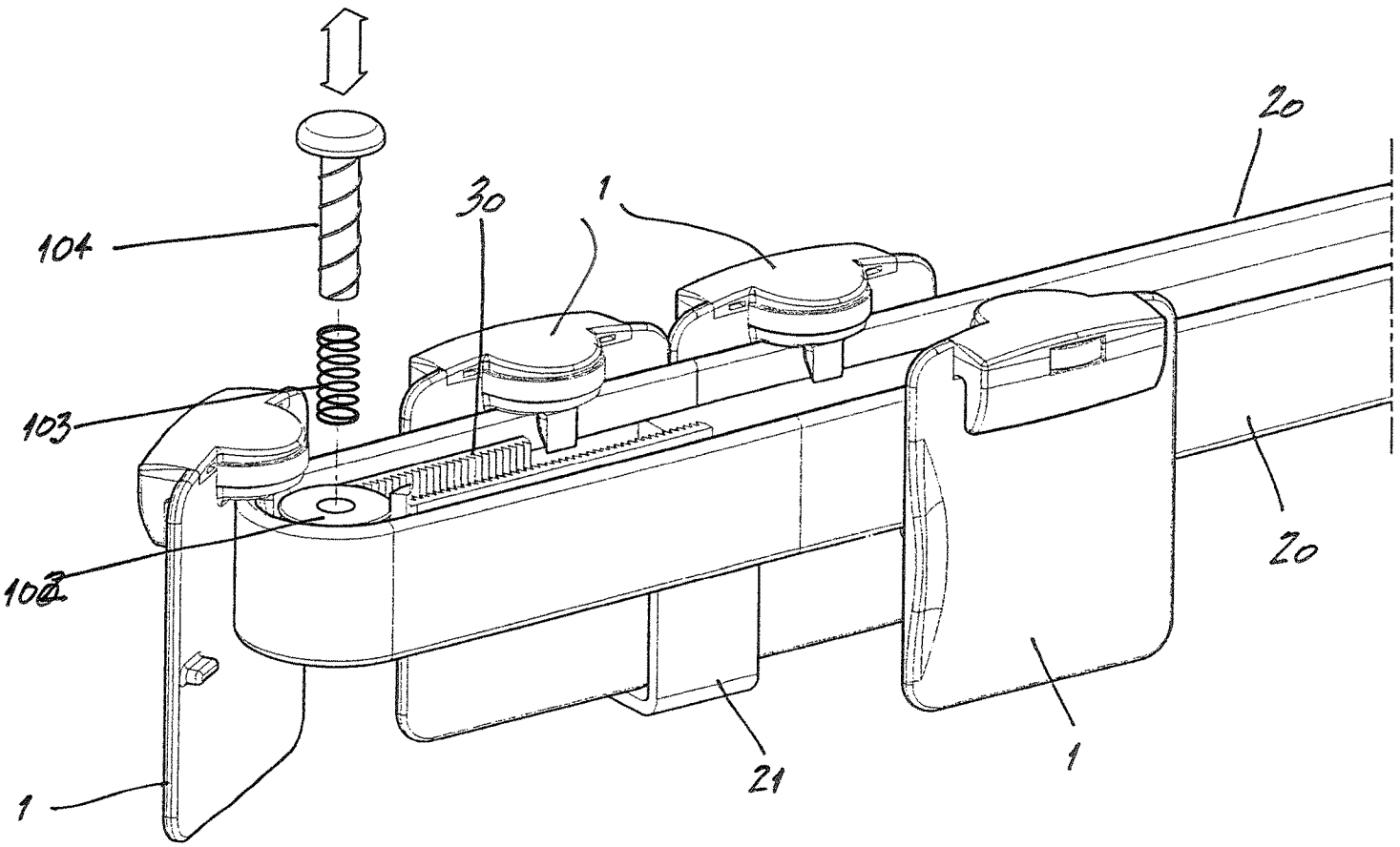
FIG. 16 is an exploded view of one end of the order wheel of FIG. 14.

In the arrangement of FIGS. 14 to 16 a ticket holder 1 may be moved along the rail 20 to come into engagement with the cam member 102 itself. Rotation of the cam member 102 serves to progressively move the ticket holder 1. When the location shown in FIG. 16 is attained, the ticket holder 1 will release itself from the cam member 102, thereby allowing for further movement thereof along the length of the rail 20.

In an alternative embodiment as shown for example in FIG. 16 the cam member 102, may have associated therewith a rack or the like 30, preferably formed from a suitable flexible material.

Figure 17:
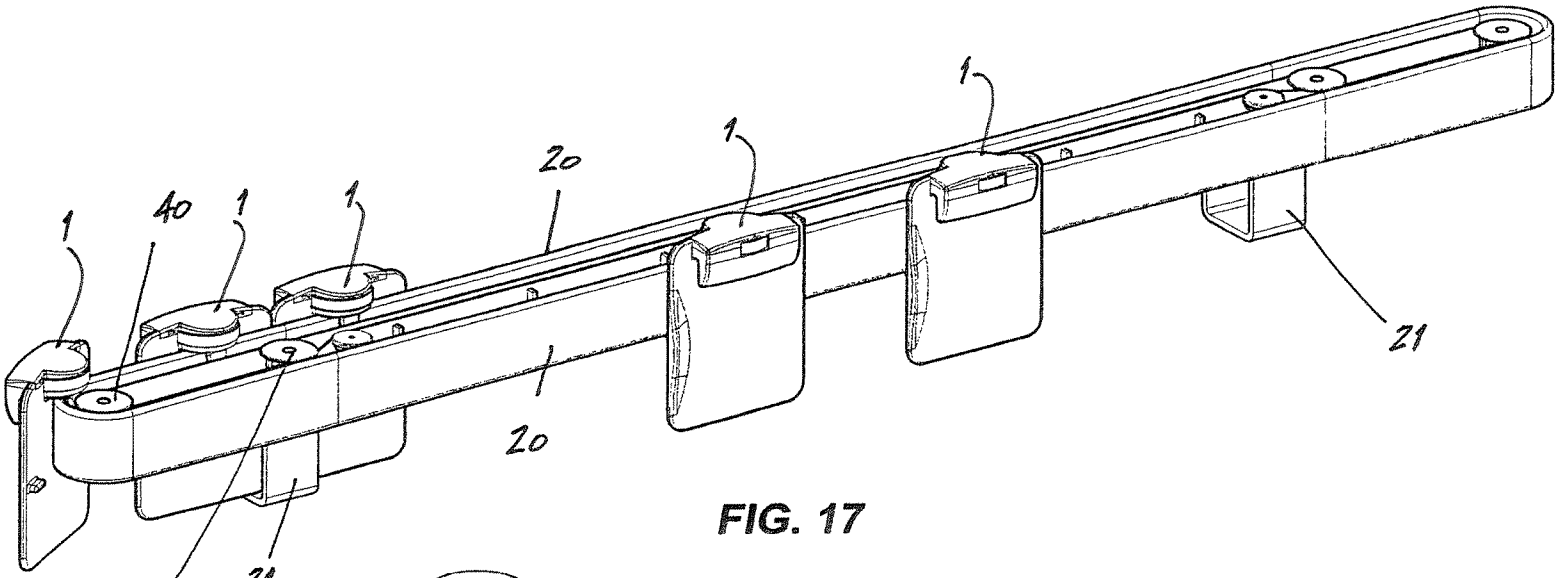
FIG. 17 is a top perspective view of yet another embodiment of an order wheel in accordance with the present invention, having a plurality of ticket or docket holders of the type shown in FIG. 1 disposed thereon.
Figure 18:
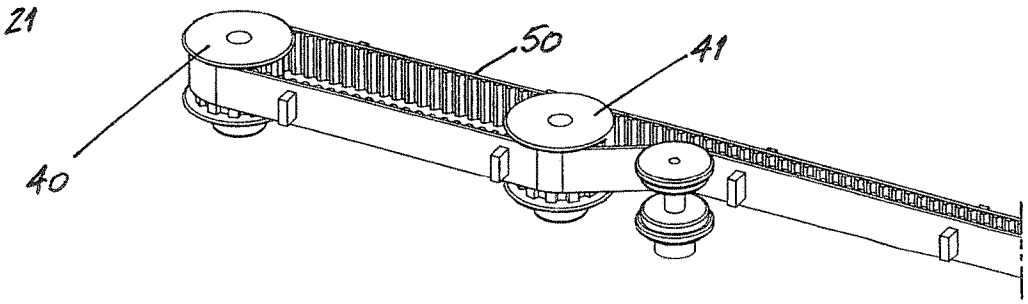
FIG. 18 is a top perspective view of the drive means of the order wheel of FIG. 17.
Figure 19:
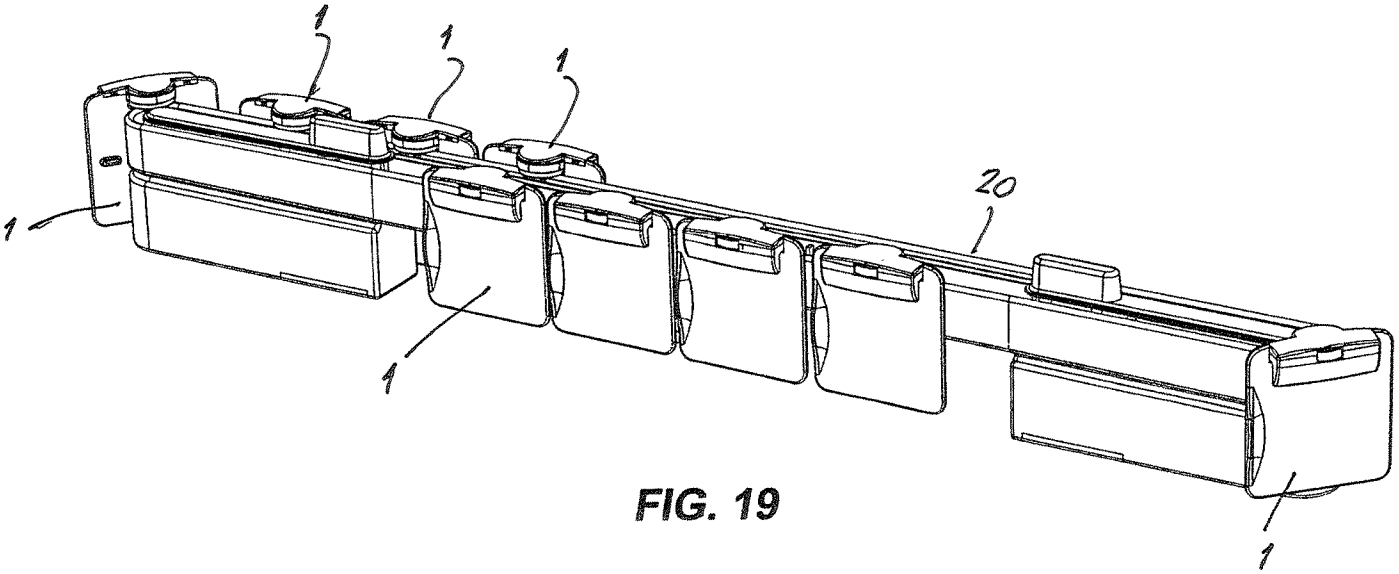
FIG. 19 is a top perspective view of yet another embodiment of an order wheel in accordance with the present invention, again having a plurality of ticket or docket holders of the type shown in FIG. 1 disposed thereon.
Figure 20:
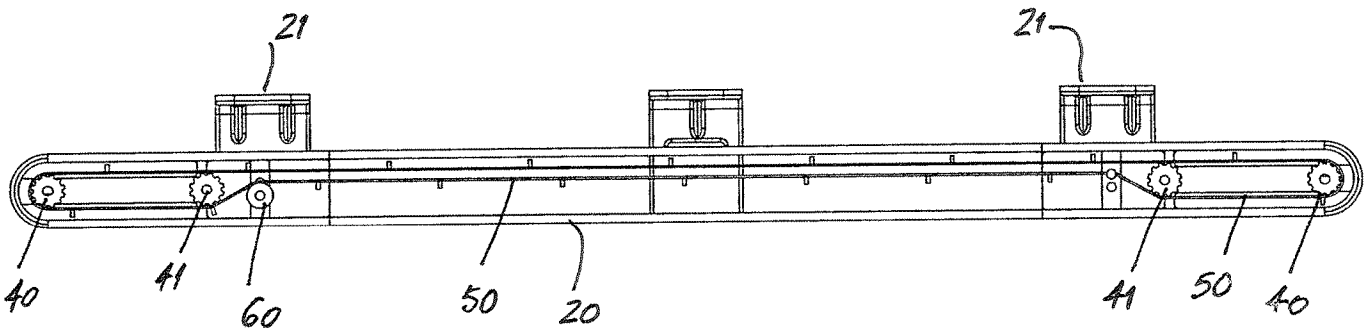
FIG. 20 is a top view of the order wheel of FIG. 19.

In yet another embodiment as shown for example in FIGS. 17 and 18 for facilitating movement of a ticket holder 1 from front to rear, and rear to front, of a rail 20, at each end of the rail 20 there may be provided two spaced-apart pulleys or rollers 40, 41, having a purpose-designed belt 50 extending therearound. In an especially preferred embodiment the pulleys or rollers 40, 41 may have gears associated therewith. The arrangement is that, when a ticket holder 1 nears the end of the rail 20, at least a part thereof comes into contact with the belt 50. Movement of the belt 50 which may be achieved either manually or by a motor or the like means, acts to drag the ticket holder 1 around the curved portion of the rail or wheel 20, as shown.

In yet another variant, again not shown, at each end of the rail 20 there may be provided two spaced-apart rollers, again having a purpose-designed belt (perhaps even with bristles). As with all other embodiments of the invention the rollers may be moved manually or by other means, as for example a motor (not shown). The belt (with bristles) serves to enhance engagement with the holders 1.

In yet another embodiment, as shown in FIGS. 17 to 20, at each end of the rail 20 there may be provided a pair of inter-acting and preferably spaced-apart rollers 40, 41 having a belt 50 extending therearound. In such an embodiment the belt 50 may have a plurality of spaced-apart teeth or bristles disposed along the length thereof. There may also be provided, at or in the vicinity of each pair of rollers 40, 41 a jockey wheel or the like 60. In such an embodiment the jockey wheel 60 can act to deflect the belt 50 away from the front length of the rail 20, allowing the holders 1 to be free to move along that front length of the rail 20 without any interference from the belt 50. Such free movement allows the user to better control the flow/movement of ticket/order holders to suit the needs of the user at any given time. Preferably at the left-hand side/end of the rail 20 the jockey-wheel 60 will redirect the belt 50 back into the vicinity of the rail 20, allowing for a tooth of that belt to come into engagement with an adjacent holder 1 and direct or force that holder 1 to traverse the end of the rail 20.

Figure 21:
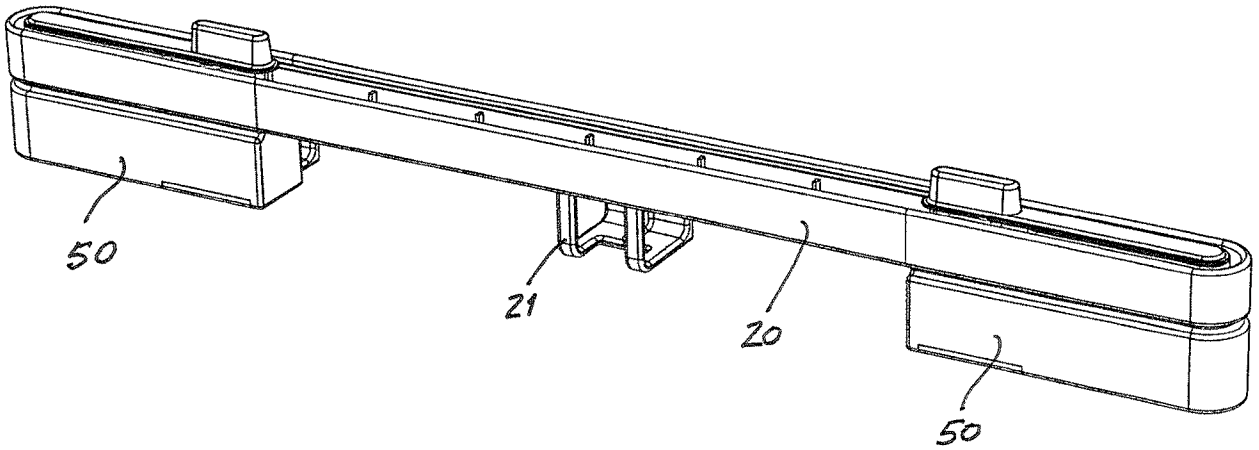
FIG. 21 is a perspective view, from the front, of an order wheel in accordance with the present invention, involving a rail adapted, in use, to be releasably affixed to a suitable surface.
Figure 22:
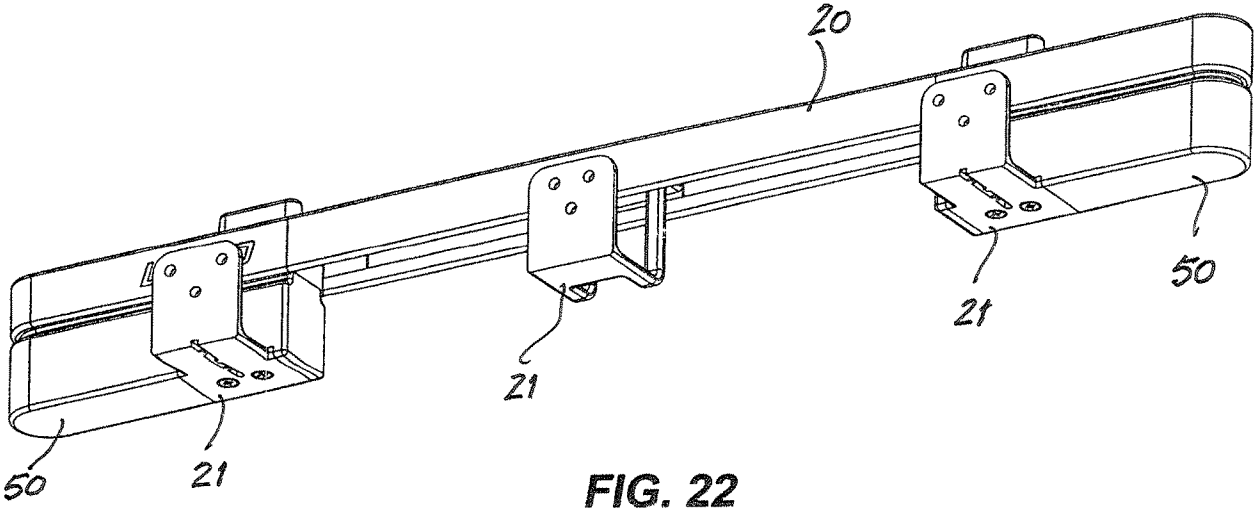
FIG. 22 is a perspective view, from the rear, of the embodiment of FIG. 21.

FIGS. 21 and 22 are respective front and rear perspective views of an especially preferred embodiment of the present invention. Such can be seen to include a rail 20, to which holders can be attached and removed as and when desired, and along or around which such holders can be moved. At each end of the loop/rail 20 the means as shown in, for example FIG. 16, for assisting in movement of a holder around the corner/end is located within a housing 50, shaped to conform to the end shape of the rail itself. In the especially preferred embodiment shown that housing 50 can have, associated therewith, a bracket 21.

Figure 23:
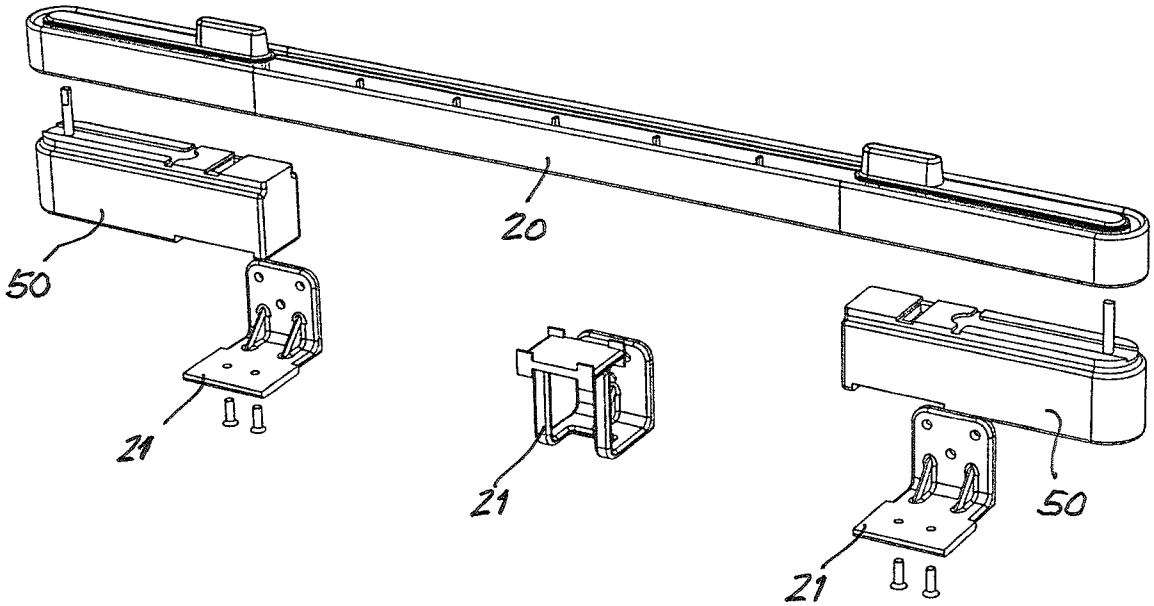
FIG. 23 is an exploded view of the embodiment of FIG. 22.

FIG. 23 shows an exploded view of the embodiment of FIGS. 21 and 22.

Figure 8:
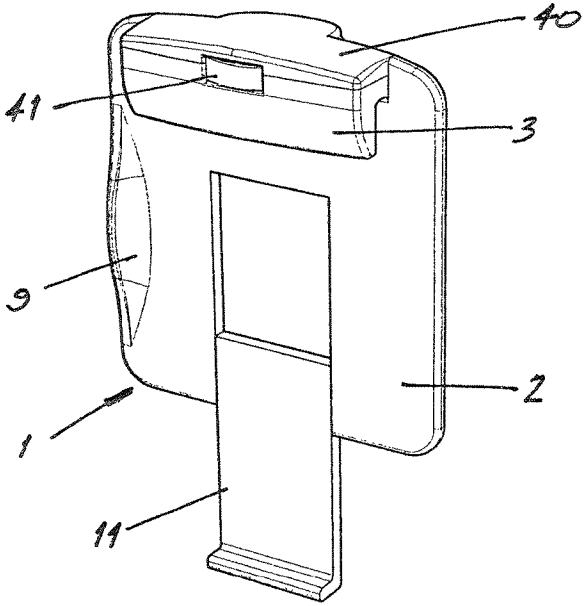
FIG. 8 is a top perspective view, from the front, of an alternative embodiment of a ticket or docket holder in accordance with the invention, showing an extensible member or ramp which functions to prevent the held ticket/order from folding backwards, thereby affording better visibility and avoiding the possibility of misreading.
Figure 7:
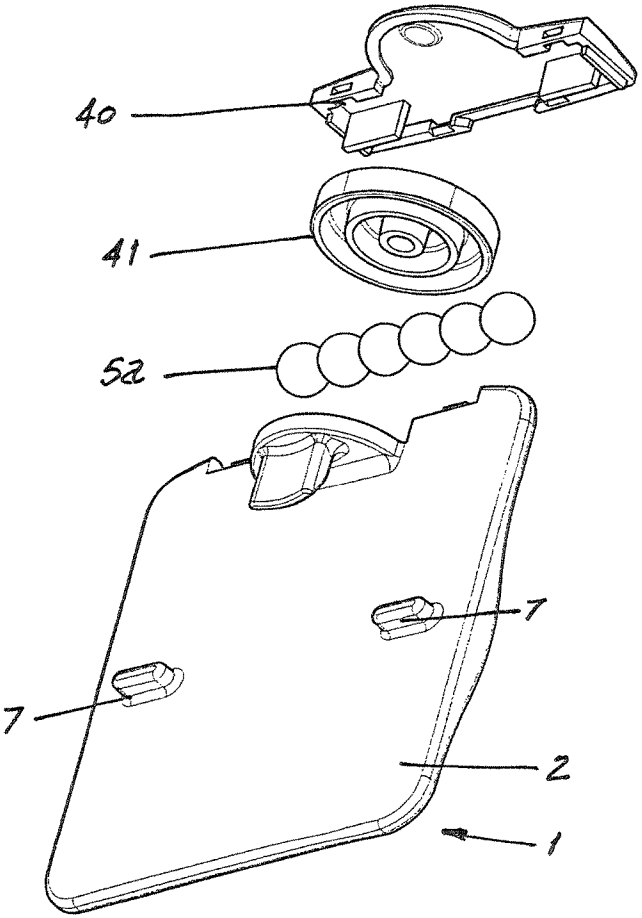
FIG. 7 is an exploded view, from the rear, of the ticket or docket holder shown in FIG. 1.
Figure 9:
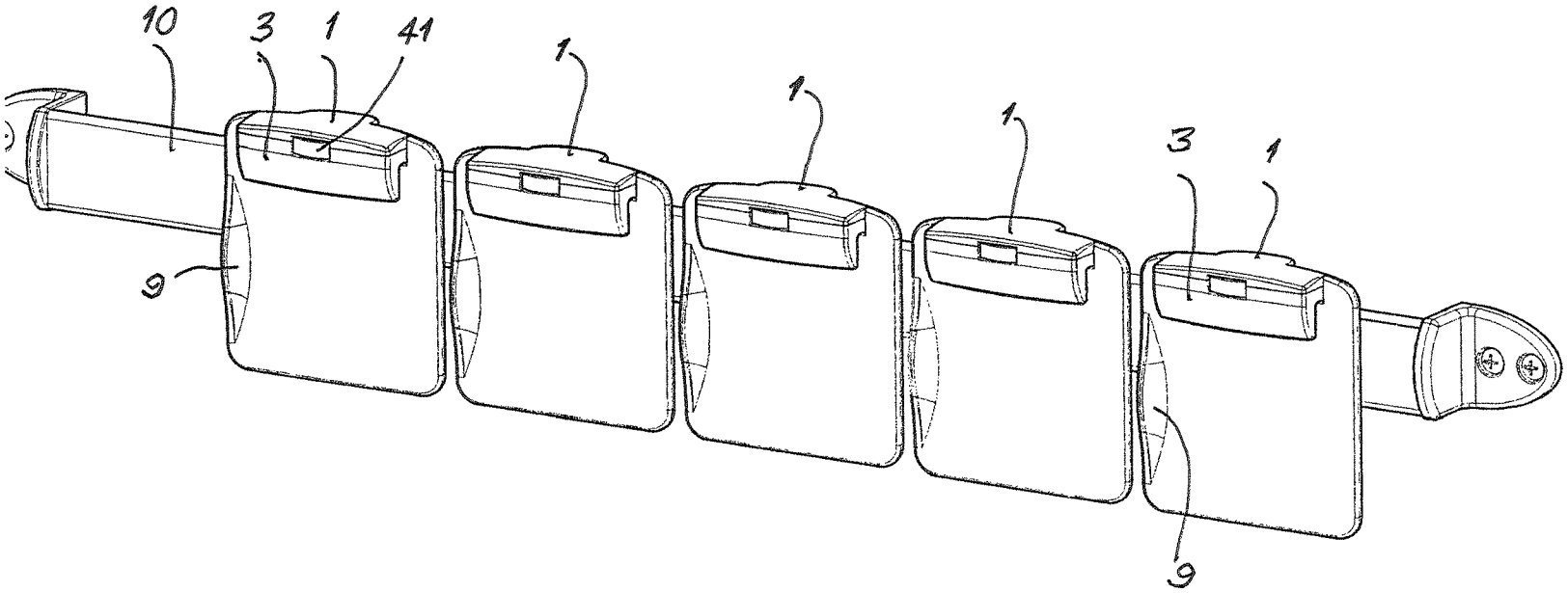
FIG. 9 is a top perspective view, from the front, of an improved apparatus in accordance with the present invention, showing an elongate rail having located thereon a plurality of ticket or docket holders of the type as shown in FIG. 1.
Figure 10:
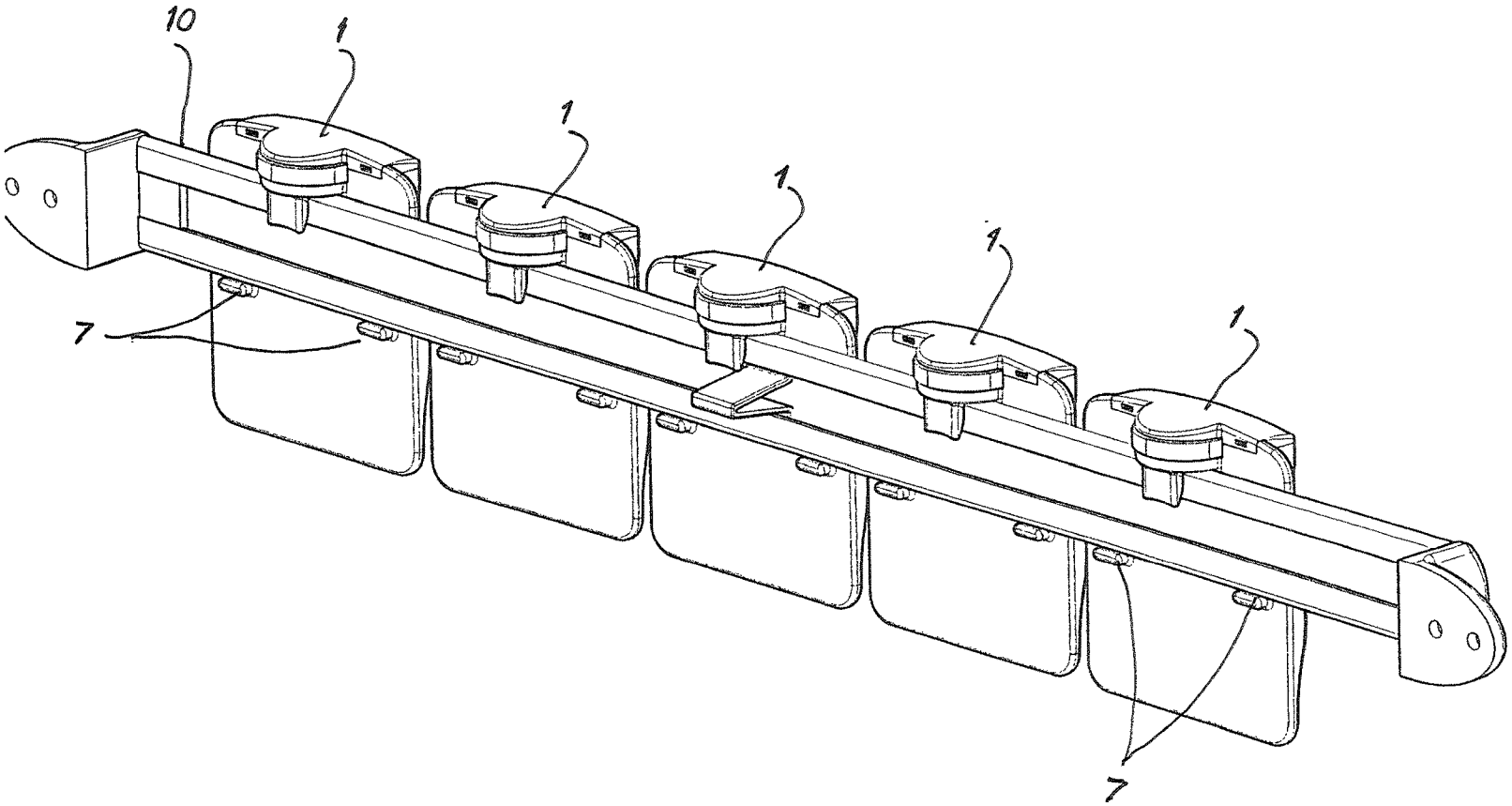
FIG. 10 is a top perspective view, from the rear, of the apparatus as shown in FIG. 9.

Turning then to FIG. 8, such shows a variant of a ticket or order holder 1 in accordance with the present invention. As with the earlier discussed embodiment, and using the same numbering system, the order holder 1 includes a main body 2 having a fixing means 3 disposed at or in the vicinity of an uppermost end thereof. The fixing means 3 disposed at or in the vicinity of an uppermost end thereof. The fixing means 3 is intended to house an array of ball-bearings 5*a* (or in the alternative a rod member). As with the embodiment of FIGS. 1 to 6 the holder 3 includes, at or in the vicinity of the uppermost edge thereof, a hook-like or hook-shaped protrusion 6 and, spaced downwardly therefrom, at least one (and preferably two) projections 7. The holder includes a cover member 40, of a shape complementary to that of the fixing means 3, wherein is disposed the ball-bearings 5*a*, and a rotatable wheel 41 of the type described earlier. This embodiment also includes a ramp 9.

The holder of FIG. 8 includes an extension member 11, which is movable downwardly relative to the holder of the position shown in FIG. 8. The extension member 11 functions to minimise, if not remove altogether, the possibility or likelihood of a ticket/order folding backwards, thereby affording unimpeded visibility to the user—the cook/chef/kitchen staff—and in turn minimising or removing the likelihood of misreading of any ticket/order.

In an especially preferred arrangement—which is not shown in the drawings—means may be provided for motorized, as distinct from hand or manual, operation of the order wheel. Such may take the form of a drive motor (of any known type) preferably to be located at or in the vicinity of one end of the rail/loop/wheel. Such motor may be actuatable in any known manner, as for example by being connected to mains power or to an external 12*v* supply.

The improved order rack and/or wheel, and associated improved order clips, in accordance with the present invention are responsible for a number of advances/improvements when compared with known and in use arrangements, as explained hereinafter in more detail.

The apparatus allows the user—as for example the chef or other kitchen staff—to selectively and independently move or shift, using a one-handed swiping action, collected orders into a desired order of priority, for filling. This simplicity of action represents an important practical advantage over known and presently in-use apparatus of this general type. The single-handed swiping motion eliminates the need for, and problems associated with, the current practice which require physical or manual repositioning of all current orders once the first order in line has been completed, whereby to make room for new/later orders to be added to the priority line.

With the present apparatus, when for example the first order in line is removed, all other orders lined up behind that first, completed order can be moved forward, with a simple one-handed swiping action, to assume earlier priority. Further, and in the instance for example of a new or previously-taken order needing to "jump the queue", to ensure expeditious completion, such can be achieved with a single-handed action. This is a distinct and worthwhile improvement over existing and in-use arrangements, which do not allow for quick and simple movement/removal/addition/repositioning of orders with a single-handed swiping action, whilst at the same time still allowing all orders to be readily visible to the cook/chef or the like.

The present arrangements will minimise paper or order handling by eliminating the need for excessive repositioning of orders along an action line, whether in the form of a rack or wheel. The arrangements in accordance with the present invention allow for orders/tickets, with their associated holders, to be slid along the rail to fill gaps left by removed tickets/orders, or in the alternative to be slid one way or the other (either clockwise or anticlockwise or forward or backward) whereby to afford room/space for addition of new tickets/orders, whether in a preferred order or in chronological order.

The present arrangement will give rise to a saving in time for the user, in a variety of ways. For example the arrangement in accordance with the present invention provides a far more efficient operating system, replacing standard order or ticket rails as currently in use which don't allow for clips to be readily moved/slid in both or either directions relative to the rail.

The improved clip of order holder allows the order—whether a ticket, coupon or the like—to be held in one hand for location on and removal from the rail—simplifying the operation.

The improved clip or order holder in accordance with the invention will also give rise to a saving in the size of the order to be held by the holder itself, in turn meaning savings in terms of paper or other material usage.

In both of the preferred embodiments shown and described, the primary purpose or function of the rail 10 and/or loop 20 is to provide a docking means for receiving and releasably housing one or more order holders. In each embodiment the order holder attaches to the rail 10 or loop 20 by being hooked over the top thereof. Once attached, an order holder can be moved, as by sliding, either to the left or right by the application of a single-handed swiping motion. In the situation where a plurality of holders are arranged, in a side-by-side relationship, that swiping motion (if properly carried out) will move all those holders in the desired direction. In a practical sense any number of individual order holders may be aligned so that the chef/cook can readily view all current orders and, as and when necessary, shift then as the first order is completed, for example, such that the previously second-in-line becomes the first in order of priority.

With the arrangement of the present invention it is possible for all order/tickets to be slid into place—whether on a rack or which—by means of a single-handed movement as swipe on a single pass across the apparatus. This is a distinct improvement over the prior art arrangements which require manual repositioning of each and every existing order/ticket so as to make room for new orders/tickets. This improvement is regardless of how many orders/tickets are already in place. There is thus a significant saving in time, not to mention effort and possible frustration, for the user.

With the present arrangement there is no need to individually reposition all other orders which are currently in place on the rack or which when any order is completed, added or removed. The user thus has total control, and can decide to slide orders one way or the other as desired, whether to fill gaps and/or add new orders/tickets.

In fact each order/ticket needs to be physically/manually handled only once, to be actually attached to a ticket holder. Thereafter that holder is moved, as by sliding, as an when desired.

Holders in accordance with the present invention, when compared with prior art arrangements, allow for physically smaller tickets/orders to be utilized, giving rise to a saving in paper use, for paper orders/tickets.

Finally, it is to be understood that the foregoing description refers merely to preferred embodiments of the invention, and that variations and modifications will be possible thereto without departing from the spirit and scope of the invention, the ambit of which is to be determined from the following claims.

The invention claimed is:

1. A holder for releasably receiving and retaining thereon an order, said holder including: a main body having opposed respective front and rear surfaces, the rear surface having means associated therewith for receiving and releasably retaining said order relative thereto, said front surface having associated therewith attachment means which allows said holder to be releasably attachable to a mounting means, which is releasably attachable to a surface to allow for selective and controlled sliding or rolling movement therealong and ready removal from and replacement on said mounting means at any selected location along the length dimension thereof, wherein said retaining means further includes means which are selectively movable to designate priority of the order carried thereby.

2. The holder as claimed in claim 1, wherein said front surface includes at least one ramp at or in the vicinity of one side thereof and extending along at least part of the height dimension of said holder, in the direction from top to bottom thereof.

3. The holder as claimed in claim 1, wherein said front surface includes, at or in the vicinity of the uppermost edge thereof and depending downwardly therefrom, a substantially L-shaped component adapted to have housed therein and extending thereacross an elongate member or rod, or a plurality of rolling members.

4. The holder as claimed in claim 1, wherein said means for receiving and releasably retaining an order relative to said main body is disposed at or in the vicinity of one end of said main body.

5. The holder as claimed in claim 1, wherein said main body is an elongate member.

6. The holder as claimed in claim 1, wherein the holder is constructed wholly or principally of a plastics material.

7. The holder as claimed in claim 1, wherein the holder is constructed wholly or principally of a metallic material.

8. The holder as claimed in claim 1, wherein said retaining means for said order is a flexible tab which is selectively movable away from and then towards the front surface of the main body of said holder to allow for an order to be disposed on said main body and to be held in place thereby relative to said main body.

9. The holder as claimed in claim 8, wherein said tab is a hook-like projection, formed integrally with said front surface of said main body at or in the vicinity of an upper end or edge of said holder.

10. The holder as claimed in claim 9, wherein said hook-like projection has a hollow interior.

11. The holder as claimed in claim 1, wherein said retaining means is a plurality of ball bearings disposed within the holder and extending transversely thereacross, the arrangement being such that an order can be disposed thereunder to be retained in place relative to the holder.

12. The holder as claimed in claim 1, wherein said retaining means is disposed at or in the vicinity of an upper end/edge of said main body.

13. The holder as claimed in claim 1, wherein said priority designating means is a substantially circular element which is divided circumferentially into discrete segments, and wherein each segment is coded to indicate the priority of an associated order, wherein said circular element is selectively movable to allow for display of a desired coded segment.

14. The holder as claimed in claim 1, wherein said receiving means is a wheel which includes at least one display means or port allowing for viewing of a colored segment of said wheel, wherein said wheel is selectively and angularly movable about a pivot axis associated with said receiving means.

15. An apparatus for the temporary display thereon of a plurality of orders, said apparatus including:

a plurality of holders, each including means for receiving, and releasably retaining an individual order thereon; and a mounting means which is releasably attachable to a surface, said mounting means receiving and releasably retaining said holders, with and/or without an order associated therewith, such as to allow for location on, removal from or selective movement of one or more of said holders relative to said mounting means, wherein said holder includes a main body having a front surface and means for receiving and releasably, retaining relative to said main body, an individual order;

wherein each said order holder further includes means which are selectively movable to designate the priority of the order carried thereby.

16. The apparatus as claimed in claim 15, wherein said mounting means is an elongate member, releasably attachable to said surface, and wherein said holders are each and individually selectively and continuously movable along said elongate member, and are readily removable from and replaceable on said elongate member at any location along the length dimension thereof.

17. The apparatus as claimed in claim 15, wherein said mounting means is a continuous loop, to be releasably affixable to said surface, and wherein said holders are each and individually selectively and continuously movable around said loop and are readily removable from and replaceable on said loop at any location therealong.

18. The apparatus as claimed in claim 15, wherein said means for receiving and releasably retaining an individual order relative to said main body of a holder is disposed at or in the vicinity of one end of said main body.

19. The apparatus as claimed in claim 15, wherein said main body of each said holder is an elongate member.

20. The apparatus as claimed in claim 15, wherein each said holder is constructed wholly or principally of a plastics material.

21. The apparatus as claimed in claim 15, wherein each said holder is constructed wholly or principally of a metallic material.

22. The apparatus as claimed in claim 15, wherein, on each holder, said retaining means is a flexible tab which is selectively movable away from and then towards the front surface of the main body to allow for an order to be disposed on said main body and to be held in place thereby relative to said main body.

23. The apparatus as claimed in claim 22, wherein said tab is a hook-like projection, formed integrally with said holder, at or in the vicinity of an upper end or edge of said holder.

24. The apparatus as claimed in claim 23, wherein said hook-like projection has a hollow interior.

25. The apparatus as claimed in claim 15, wherein said main body of each said holder includes opposed respective front and rear surfaces.

26. The apparatus as claimed in claim 25, wherein said front surface of each said holder includes at least one ramp at or in the vicinity of one side thereof and extending along at least part of the height dimension thereof, in the direction from top to bottom thereof.

27. The apparatus as claimed in claim 25, wherein said front surface of each said holder includes, at or in the vicinity of the uppermost edge thereof and depending downwardly therefrom, a substantially L-shaped compartment adapted to have housed therein and extending thereacross an elongate member or rod, or a plurality of rolling members.

28. The apparatus as claimed in claim 15, wherein, on each holder, said retaining means is a plurality of ball bearings disposed within the holder and extending transversely thereacross, such that an order can be disposed thereunder to be retained in place relative to the holder.

29. The apparatus as claimed in claim 15, wherein said priority designating means is a substantially circular element which is divided circumferentially into discrete segments, and wherein each segment is coded to indicate the priority of an associated order, wherein said circular element is selectively movable to allow for display of a desired coded segment.

30. The apparatus as claimed in claim 15, wherein said priority designating means is a wheel which includes at least one display means or port allowing for viewing of a colored segment of said wheel, wherein said wheel is selectively and angularly movable about a pivot axis associated with said holder.

31. The apparatus as claimed in claim 15, wherein said mounting means is releasably affixable to and spaced from said surface, whether vertical or horizontal, by one or more brackets.

32. The apparatus as claimed in claim 15, wherein said mounting means is of metal.

33. The apparatus as claimed in claim 15, wherein said mounting means is of a plastics material.

* * * * *